United States Patent [19]

Morris et al.

[11] Patent Number: 5,031,774

[45] Date of Patent: Jul. 16, 1991

[54] NESTABLE BEVERAGE CAN TRAY

[75] Inventors: Peter M. Morris, Wareton; Robert C. Allabaugh, Barnegat, both of N.J.

[73] Assignee: Paper Casepro, Manasquan, N.J.

[21] Appl. No.: 476,883

[22] Filed: Feb. 8, 1990

[51] Int. Cl.[5] ..... B65D 21/02; B65D 85/62

[52] U.S. Cl. ..... 206/519; 206/427; 206/504; 206/518; 206/564; 330/519; 217/26.5

[58] Field of Search ..... 206/427, 503, 509, 518, 206/519, 557, 558, 564, 565; 217/26.5

[56] References Cited

U.S. PATENT DOCUMENTS

| | | | |
|---|---|---|---|
| D. 274,110 | 6/1984 | Vigue . | |
| 3,009,579 | 11/1961 | Ettlinger | 206/509 |
| 3,186,587 | 6/1965 | Englander et al. . | |
| 3,349,943 | 10/1967 | Box . | |
| 3,651,976 | 3/1972 | Chadbourne . | |
| 3,765,592 | 10/1973 | Chadbourne | 217/26.5 |
| 3,794,208 | 2/1974 | Roush et al. . | |
| 3,826,229 | 7/1974 | Classe | 206/519 |
| 3,891,084 | 6/1975 | Elizaondo-Garcia . | |
| 3,949,876 | 4/1976 | Bridges et al. . | |
| 3,967,747 | 7/1976 | Wagner | 206/519 |
| 4,098,403 | 7/1978 | Davis | 206/519 |
| 4,344,530 | 8/1982 | de Lorsiere . | |
| 4,410,099 | 10/1983 | de Larosiere | 206/427 |
| 4,548,320 | 10/1985 | Box | 206/427 |
| 4,615,443 | 10/1986 | Deffner | 206/427 |
| 4,615,444 | 10/1986 | de Larosiere | 206/427 |
| 4,625,908 | 12/1986 | Emery . | |
| 4,834,243 | 5/1989 | Langenbeck | 206/427 |
| 4,896,774 | 1/1990 | Hammett | 206/518 |
| 4,932,532 | 6/1990 | Apps et al. | 206/503 |

FOREIGN PATENT DOCUMENTS

| | | | |
|---|---|---|---|
| 2032886 | 5/1980 | United Kingdom | 217/26.5 |

*Primary Examiner*—George E. Lowrance

*Attorney, Agent, or Firm*—Mason, Fenwick & Lawrence

[57] ABSTRACT

A molded, stackable and nestable beverage can tray having tapered side walls and end walls, contoured window openings in both the side walls and end walls, and having contoured window openings in both the side walls and end walls to snugly contain the cans is disclosed. The bottom length and width dimensions of the tray are less than the sum of the diameters of rows of cans placed in the tray. Trays according to the invention have a 3:2 length-to-width ratio for cross-tying stacks, and have a tray bottom design having generally diamond-shaped standoffs projecting downwardly from the bottom of the tray to lock onto the tops of the cans contained in the tray immediately beneath the can tray. The trays include can bottom seating rings capable of receiving and centering cans having a range of bottom diameter dimensions. Trays according to the invention have side walls and end walls which are tapered at an angle of preferably 10°, thereby enabling the trays to be nested to 67% of their overall height when stacked in an empty condition.

15 Claims, 8 Drawing Sheets

NESTABLE BEVERAGE CAN TRAY

RELATED APPLICATION CROSS-REFERENCE

The subject matter of this invention is related to that of U.S. Design Patent application Ser. No. 07/441,155, filed Nov. 22, 1989.

FIELD OF THE INVENTION

The present invention relates to molded packaging trays (1) capable of being loaded with a plurality of beverage containers, (2) capable of being stacked when loaded with other similar trays one above the other, and (3) capable of being stacked when empty with one tray nested within another. The present invention relates more specifically to stackable, nestable packaging trays which may be nested one within another when the trays are empty, and which may be stacked in a variety of interlocking arrangements when loaded with beverage cans or similar containers or items.

BACKGROUND OF THE INVENTION

Packaging trays molded of thermoplastics, paper pulp and similar materials are widely used to support, organize and stabilize loads of relatively fragile, easily disordered goods, such as beverage cans. In the beverage can filling industry, beverages are generally loaded and transported in 24-can case loads. Since the time between bottling or canning and delivery to the customer is relatively brief, and because the cans employed fully contain the beverage, it is common industry practice not to enclose or seal case loads in packaging such as crates or cardboard boxes. Rather, the filled cans are typically placed in case loads on rectangular corrugated cardboard shipping trays in rows of six cans and four cans respectively parallel to the longest and shortest dimensions of the tray. The loaded shipping trays are stacked in an interlocked arrangement atop a wooden pallet. Corrugated cardboard shipping trays conventionally used include a cardboard bottom and four short vertical sides approximately two inches in height. When the conventional trays are loaded with filled beverage cans, the weight of the cans compresses the cardboard bottom, producing circular impressions formed by the can in the cardboard beneath each can bottom. These impressions help reduce movement of the cans during sudden lateral movement of the tray.

In a typical cross-tied arrangement, loaded trays are placed on a pallet such that adjacent trays are oriented at a 90° angle to one another, rather than being placed in parallel rows. Further, trays are placed such that they are oriented at a 90° angle with respect to subjacent trays. The entire cross-tied "palletized" load then is moved using a forklift and loaded onto a truck for delivery to the final destination.

However, beverage can packaging trays in the prior art have not provided adequate stability for the palletized load. Conventional, non-interlocking trays are stabilized atop a pallet only by the combined weight of the beverage cans and trays. Accordingly, there is great risk that the loaded trays may shift in transit, or that individual cans may be dented, scratched or have their labels blemished by can vibrations and consequently rendered in unsalable or unattractive condition. Further, palletized stacks of conventional, loaded can trays must be wrapped with strong, plastic stretch wrap or other material to prevent lateral shifting of the palletized load in transit.

It is also desirable that empty packaging trays be capable of nested storage to reduce space occupied in a warehouse, store or truck while awaiting return to the bottler for subsequent reuse. However, packaging trays in the prior art have been either not capable of nesting at all, or capable of nesting only to a limited depth; thus, such prior art trays occupy a large volume of storage space.

Attempts to produce interlocking can shipment trays to circumvent these disadvantages have not solved all of the problems presented above. For example, U.S. Pat. No. 3,949,876 (Bridges et al) teaches the use of a tray for serving beverages having depressions on its upper surface for receiving the bottoms of insulated tumblers or mugs, and having recesses formed in its bottom surface to receive the tops of tumblers or mugs in a stack below. However, the trays described by Bridges do not permit interlocked, cross-tied stacking, and therefore do not substantially increase the stability of a highly stacked load. Similarly, U.S. Pat. No. 3,651,976 (Chadbourne) discloses a nestable, interlocking packaging tray for a variety of goods which permits multi level stacking, with alternate trays oriented differently from adjacent ones. However, the tray described by Chadbourne makes no provision for assuring the stability of goods placed within the tray.

This last-mentioned disadvantage was partially circumvented by U.S. Pat. No. 3,349,943 (Box), which discloses a bottle carrying and stacking case having a plurality of recesses molded into the bottom of the case for receiving and interlocking with the tops of bottles carried in a case below. The Box disclosure also provides highwalled separate storage compartments for each bottle, but the case described by Box does not permit efficient, nested stacking of empty cases.

Likewise, U.S. Pat. No. 4,625,908 (Emery) provides a closed-bottle packaging container having molded restraints for preventing lateral motion of bottles in the container, but the container may not be nested. Further, U.S. Pat. No. 3,891,084 (Aleizondo-Garcia) provides a basket for carrying bottles having contoured carrying compartments, but the basket is not designed for interlocked stacking and nesting. It is also desirable that beverage can packaging trays be lightweight to facilitate easy return to the bottler. Prior art trays are made of corrugated cardboard, a material which is inherently lightweight. Molded plastic trays are considerably heavier, but general concepts for reducing their weight are well known in the prior art. For example, U.S. Pat. No. 3,794,208 (Roush et al) shows a packaging tray having a gridwork bottom which reduces weight by reducing the amount of plastic required to form the tray bottom. However, the Roush disclosure does not provide for efficient crosstied stacking or nesting of trays.

To achieve the desired goal of deeply nestable trays, the present invention provides angled sides having a plurality of contoured cut-out windows in the tray sides which permit cans placed in the tray to extend beyond a plane perpendicular to the bottom of the tray. The use of such contoured windows to provide clearance space for beverage containers is shown in the Aleizondo-Garcia patent which discloses a beverage bottle carrying basket having similar contoured windows set in to tapered side walls. However, the Aleizondo-Garcia invention is unsuitable for cross-tied interlocked shipment of can case loads.

Further, the use of contoured window cut-outs in the base of a beverage container carrier is described in U.S. Pat. No. 3,186,587 (Englander et al). However, the window cutouts in the Englander disclosure do not contribute to efficient nesting of the container carriers, but merely enhance the structural strength of the paperboard carrier described. Therefore, persons in the beverage canning, bottling and packaging industry would find it desirable to have a beverage can packaging tray capable of efficient nesting when empty, and capable of sturdy, interlocked, stacked arrangements when the tray is fully loaded. This present invention meets this need.

SUMMARY OF THE PRESENT INVENTION

Accordingly, it is the primary object of the present invention to provide a new and improved beverage can tray.

A further object of the present invention is to provide a stackable and nestable beverage can tray having tapered, contour-windowed, side and end walls to snugly contain and support cans such that the length and width dimensions of the bottom tray portion are less than the sum total, measured lengthwise and widthwise, of the diameters of rows of cans.

It is another object of the invention to provide a unique beverage can packaging tray having a 3:2 length-to-width ratio to readily facilitate cross-tying stacks during transit, which ratio further ensures that all cross-tied stack arrangements palletize with no overhang between tiers with an absolute minimum of overhang on most pallet sizes.

It is a further object of the present invention to provide an improved stackable and nestable beverage can tray having a bottom molded with recesses to receive tops of cans loaded in a subjacent tray and interior molded can support wells which limit lateral motion of the cans such that a palletized load comprising a plurality of loaded, cross-tied, interlocked stacks of trays is sufficiently stable to preclude the need for using stretch-wrap or other restraint on the load.

It is yet another object of the present invention to provide an improved stackable and nestable beverage can tray having tapered walls molded at an angle sufficient to permit nesting of stacked empty trays to a depth of a substantial portion of their overall height.

It is still a further object of the present invention to provide an improved stackable, nestable beverage can tray having contoured cut-out windows to permit the lower ends of beverage cans placed in the tray to extend outwardly beyond the bottom periphery of the tray.

The foregoing objects of the invention, and other objects which will become apparent hereinafter, are achieved through the provision of a molded, stackable and nestable beverage can tray having tapered side walls and end walls, contoured cutout windows in both the side walls and end walls to snugly contain the cans such that the bottom length and width dimensions of the tray are less than the sum of the diameters of rows of cans placed in the tray, a 3:2 length-to-width ratio for cross-tying stacks, a tray bottom design provided with a plurality of molded interlock standoffs projecting from the bottom of the tray to lock onto the top outer surfaces of the cans contained in subjacent trays, and molded tabs which prevent nested, empty trays from nesting too deeply and becoming locked together by material tension. In the preferred embodiment of the invention, the trays of the invention have side walls and end walls which are tapered at an angle of 10°, thereby enabling the trays to be nested to 67% of their overall height when stacked in an empty condition; the overall length and width dimensions of the bottom portions of the trays are also substantially reduced in comparison to those in the prior art by providing contoured can bottom receiving windows in the side walls and end walls.

DETAILED DESCRIPTION OF THE PREFERRED EMBODIMENTS

Figure 1:
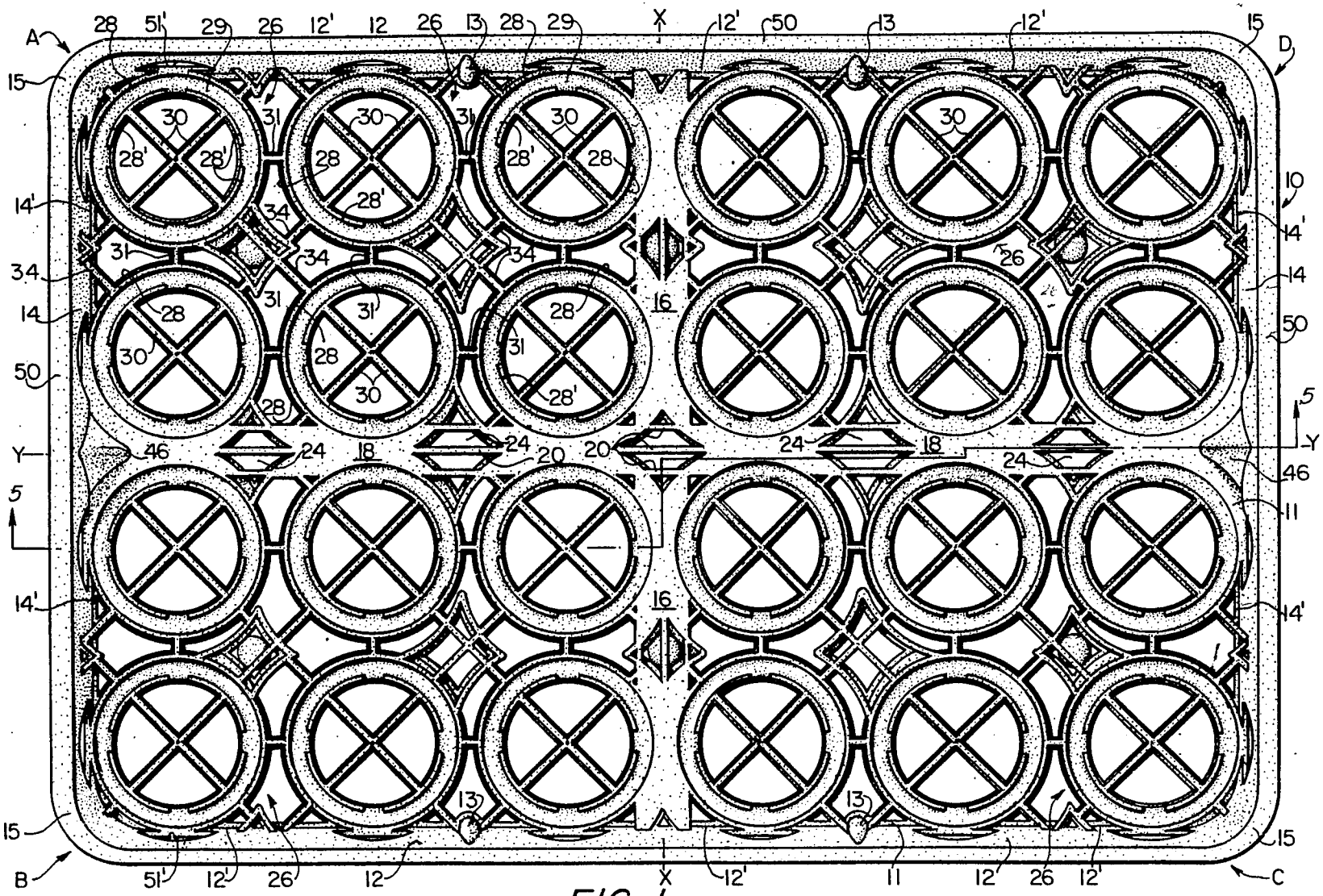
FIG. 1 is a top plan view of the preferred embodiment of a beverage can tray according to the present invention.

In describing the preferred embodiment of the subject invention illustrated in the drawings, specific terminology is used for the sake of clarity. However, the invention is not intended to be limited to the specific terms so selected, and each specific term includes all technically equivalent terms for items operating in a similar manner to accomplish a similar purpose.

Referring generally to FIGS. 1 through 5, and referring specifically to FIG. 1, a top plan view of an injection molded unitary can tray according to the present invention is shown and is generally designated by reference numeral 10. The tray 10 is formed of molded identical end walls 14 and molded identical front and rear walls 12, which front and rear walls 12 and end walls 14 meet at four quarter-round-molded corners 15. The tray also includes a rectangular tray bottom portion having front and rear edges 12' defined by the intersection of the bottom portion 11 with the lower edges of front and rear walls 12; similarly, the tray bottom portion 11 has end edges 14' defined by its intersection with the lower edges of end walls 14 as illustrated in FIG. 1.

Figure 2:
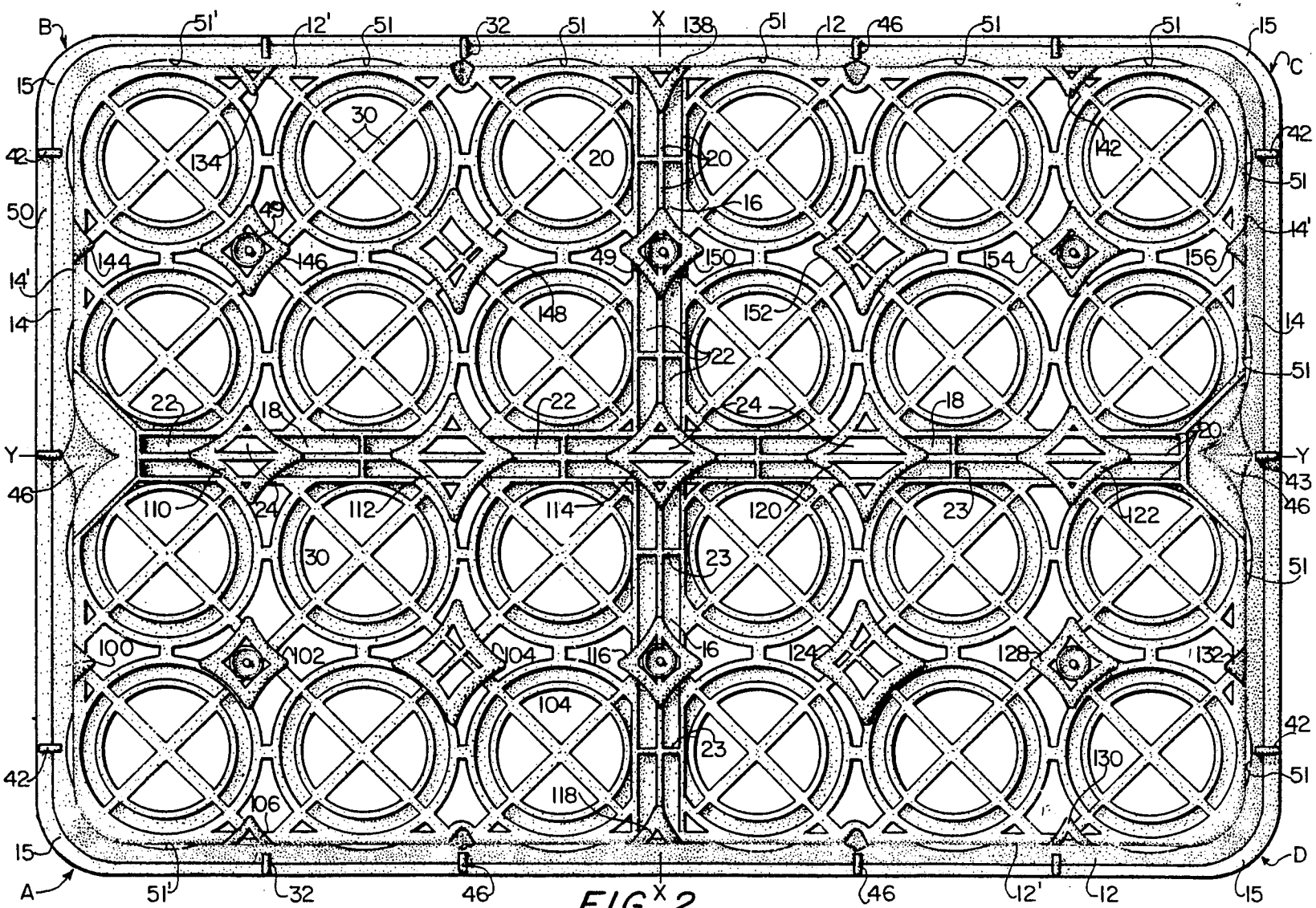
FIG. 2 is a bottom plan view of the tray of FIG. 1.

Structural strength is provided by elements of the bottom portion 11 of the tray 10 by means including two triple-rib center channels 16 and 18 formed unitarily in, and being part of, bottom portion 11. As FIGS. 1 and 2 show, channel 16 extends along a front to rear axis and connects perpendicularly to the walls 12 at a point approximately midway between the molded corners 15 such that a center line drawn along channel 16 defines a front to rear axis X. Similarly, channel 18 connects perpendicularly to the centers of end walls 14 at a point approximately midway between the corners 15 such that a center line drawn along channel 18 forms transverse axis Y. FIG. 2, the bottom plan view, shows in detail that channels 16 and 18 substantially comprise three parallel vertical ribs 20 joined by molded webbing 22, connected by transverse rib plates 23 and having cut-outs 24 in the webbing 22. Cut-outs 24 are generally trapezoidally-shaped, with the non-parallel sides being curved inwardly. This arrangement provides structural strength substantially equivalent to that provided by solid ribs having no channels or cut-outs, while allowing the angular surfaces of the trapezoids to be cored out from the top side of the tray.

The tray 10 depicted in FIG. 1 is divided by axes X and Y into four similar quadrants designated A, B, C and D. The structural arrangement of parts within each quadrant A, B, C or D is identical except for differences in location. For example, quadrant D is a geometric reflection (mirror image) of quadrant A over axis X. Similarly, quadrant C is a mirror image reflection of quadrant D over axis Y. Further, quadrant B is a mirror image reflection of quadrant A over axis Y. To preserve the clarity of FIGS. 1 and 2, reference numerals are mainly shown only for parts within quadrant A. However, it is intended and the reader should understand that the reference numerals apply to symmetrically identical parts shown in symmetrical quadrants A, C and D.

Figure 13:
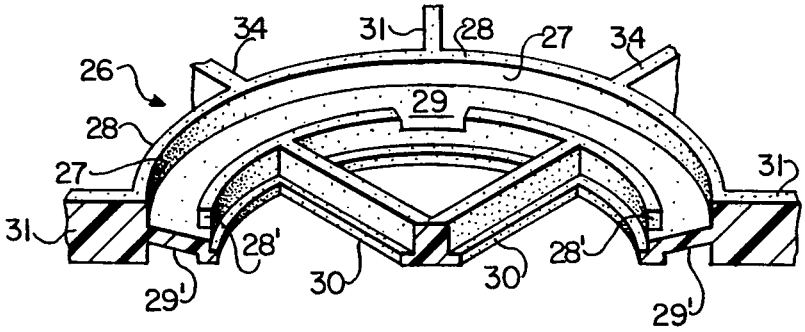
FIG. 13 is a partial perspective bisecting sectional view of one of the twenty four can support rings employed in the preferred embodiment of the present invention.
Figure 14:
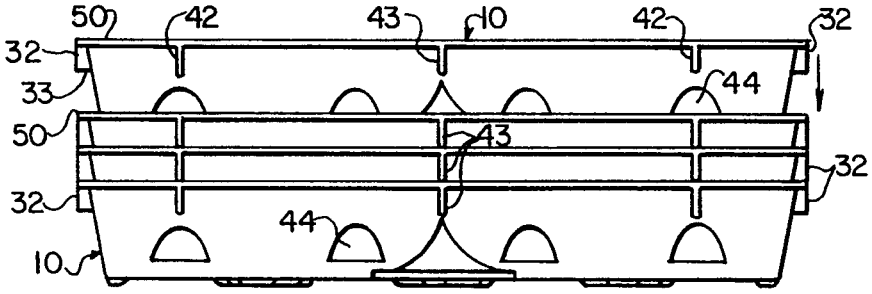
FIG. 14 is an end elevation view of a nested stack of empty trays according to the present invention.
Figure 17:
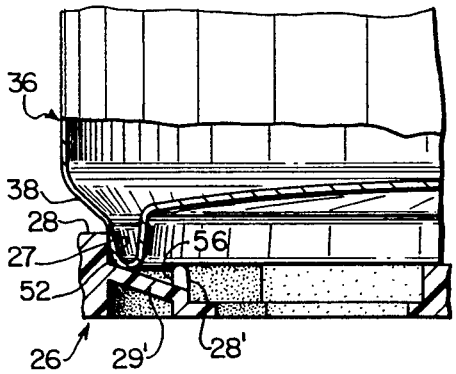
FIG. 17 is a partial sectional view of the lower end of a larger diameter can body illustrating its positioning in a can support ring of the type shown in FIG. 13.
Figure 18:
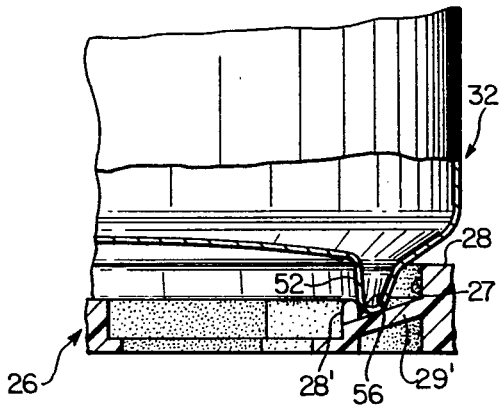
FIG. 18 is a partial sectional view of a smaller diameter can body similar to FIG. 17, but illustrating the manner of engagement of a smaller diameter can bottom with the can support ring.

It should be noted that quadrant A appears in a different position in FIG. 2 compared to FIG. 1. However, FIG. 2 is a bottom plan view obtained by conceptually rotating FIG. 1 1800 about transverse axis Y. By conducting such a rotation of the top plan view, it may be seen that FIG. 2 properly shows the position of all quadrants. Each quadrant includes a plurality of molded can supports each generally designated 26 and including rings 28 formed unitarily in, and being part of, bottom portion 11 as shown in FIGS. 13, 17 and 18; can support rings 28 limit lateral motion of cans placed in the tray. In the preferred embodiment shown in FIG. six can supports 26 are provided in each quadrant of the tray. The ring 28 of each can support 26 defines the outer extent of an annular channel 29, defined by the inner surface 27 of ring 28, interior ring segments 28' and a relatively flat conical annular floor 29' which slopes inwardly downward as shown in FIGS. 5, 13, 17 and 18.

As further shown in FIGS. 13, 17 and 18, interior ring segments 28' are molded having a height less than exterior rings 28. This structure permits the can tray rings to support and restrain cans having a range of bottom diameters including the larger diameter annular can bottom such as exemplified by can 36 in FIG. 17, or cans having smaller diameter annular can bottoms as exemplified by can 52 in FIG. 18. As specifically shown in FIG. 17, a can 36 having a standard annular bottom is seated in channel 29 with the can being retained in place by contact between the outer wall 38 of the can 36 and the inner surface 27 of ring 28.

In contrast, as shown in FIG. 18, cans 52 having a smaller diameter annular can bottom are also seated in channel 29, but are laterally retained in place by contact between the inner surface 56 of the can bottom annular rib and the outer surface of interior ring segment 28'. The double ring structure including rings 28 and ring segments 28' according to the present invention represents a significant advance over the prior art in that it permits cans having a range of can bottom diameters to be used in the same can tray. The rings and annular rib will also cause a can of intermediate size to center itself while rings 28' prevent excessive movement. A further significant aspect of the invention is that the conical annular floor 29' will tend to center a range of can diameters in the can support 26 in an obvious manner.

Four ring segments 28' are used, rather than a contiguous inner ring, to permit drainage of any moisture or spilled fluid which may collect in channel 29. Such fluid will drain through the spaces between segments 28' and out the tray 10, thereby preventing accumulation of fluid in channel 29.

Each ring 28, ring segment 28' and channel 29 is braced by diagonal cross ribs 30 shown in FIGS. 1, 2 and 13. The ribs 30 help distribute can weight to the entire tray 10, and the ribs 30 further ensure that the tray 10 remains rigid against torque or force exerted to twist or bend the tray 10 along a plane perpendicular to the ribs 30. Cross ribs 30 are used rather than a solid bottom for the rings 28 to save molding material and reduce tray weight. The ribs 30 are also valuable in providing structural strength against stress applied in a diagonal direction with respect to walls 12 or 14 of tray 10. The can supports 26 are interconnected by ring link ribs 31 (FIGS. 1, 2 and 13) and diagonal extension ribs 34, which ribs transmit stress to adjacent rings 28 of different can supports where such stress is absorbed.

In an alternative embodiment, depicted in FIGS. 6 through 9, the rings 28, ring segments 28', conical annular floor members 29' and ribs 30 are molded to incorporate year date coding rings 900 and month date coding rings 950. As shown in the top plan view of FIGS. 7 and 9, the date coding ring 900 and the month coding ring 950 have a generally disk shaped, flat molded top. Specifically, year date coding ring 900 includes top molded surface 902, and month coding ring 950 includes top molded surface 952. In the bottom plan view of FIG. 6, the details of year date coding ring 900 are shown. The ring 900 is defined by outer circular rib 912 and interior flat surface 904. Upon surface 904 is molded a year date ring 906, into which a plurality of numerical year codes 914 are molded. A molded arrow 908 is provided, molded upon interior planar surface 910. Depending upon the year of manufacture of a tray 10, the arrow 908 is molded to point to the appropriate year date molded into ring 906.

Figure 8:
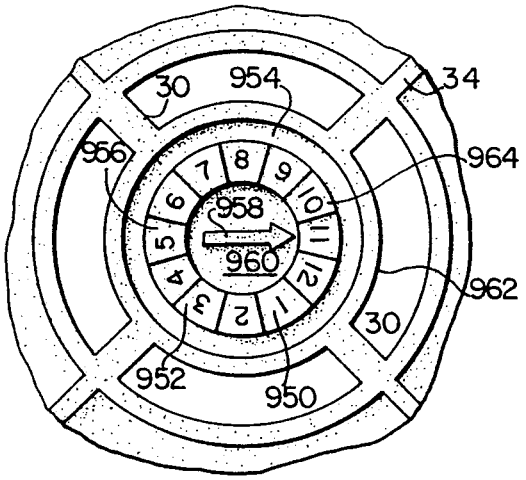
FIG. 8 is a bottom plan view of a molded month date coding ring incorporated in one embodiment of the present invention.

The similar details of month coding ring 950 are shown in FIG. 8. The perimeter of ring 950 is defined by ring rib 962, and is filled with a flat planar molded surface 954. A raised molded month coding ring 956 is provided, and numerals 964, corresponding to months of the calendar year, are molded into the ring 956. The interior of ring 956 is filled by flat circular planar surface 960. A raised molded indicator arrow 958 is provided, and depending upon the month of manufacture of a tray 10, the arrow 958 is molded to point to a corresponding numeral 964.

FIGS. 1, 3, 4, 5 and 14 show in detail the structural details which permit the empty trays to be nested in a space-saving manner while permitting an easy separation of the nested trays. More specifically, front and rear walls 12 and end walls 14 of the tray 10 are integrally connected at their upper edges to a peripheral top lip 50 extending the full length and width of the tray 10. A plurality of front and rear tabs 32 (FIG. 4), preferably four tabs 32, protrude outwardly (forwardly or rearwardly) from walls 12 and downwardly from top lip 50 with tabs 32 being connected perpendicularly to and of the walls 12 and lip 50. End tabs 42 identical to tabs 32 are provided on end walls 14 and are identically connected to the lower surface of top lip 50 in the same manner as tabs 32. The tabs 32 are shown in profile in FIG. 4. The tabs 32 and 42 add structural strength to the tray; further, the tabs 32 and 42, respectively, have lower edges 33 and 43 which rest on the upper surface of a subjacent top lip when in empty stacked array as in FIG. 14 to present empty nested trays from nesting too deeply. When a plurality of empty trays 10 are nested, the bottom surface 33 and 43 of the tabs 32 engages the lip 50 of the subjacent tray. Thus, the tabs 32 prevent one tray 10 from being forced too deeply into a tray 10 below it, which deep nesting causes prior art trays to become wedged within each other such that they can be extremely difficult to separate.

The tabs also prevent the top lip 50 from riding over or under the top lip of an adjacent tray if tray side walls collide when a palletizer machine squares up each tier of a pallet load or when the trays are travelling on conveyors.

Figure 3:
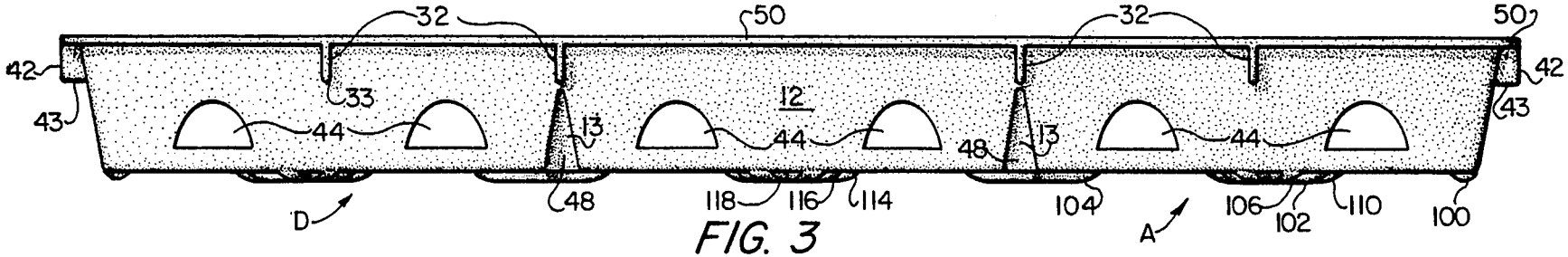
FIG. 3 is a side elevation of the tray of FIG. 1.

Front and rear walls 12 are further provided with preferably two molded external notches 48 formed of inwardly bulging wall portions 13 (FIGS. 1 and 3) each of which is aligned with one of the notch tabs 32 as shown in FIG. 3. The tabs 32, in conjunction with notches 48, increase the structural strength of walls 12 by cooperatively forming a barrier highly resistant to stress applied perpendicular to end walls 14. Thus, the notches 48 and tabs 32 strengthen the walls 12 against lateral force exerted when tray ends are pushed against each other in a palletized stack.

End walls 14 each include a centrally molded externally positioned notch 45 formed of inwardly bulging wall positions 46 (FIG. 1) vertical alignment with an end tab 42. The aforementioned end tab, in conjunction with notch 45, increases the structural strength of end walls 14 which resists stress applied perpendicular to front and rear walls 12. Thus, the end walls 14 are strengthened against sudden lateral force exerted when front and rear walls 12 of adjacent trays are pushed against each other in a palletized stack.

Figure 4:
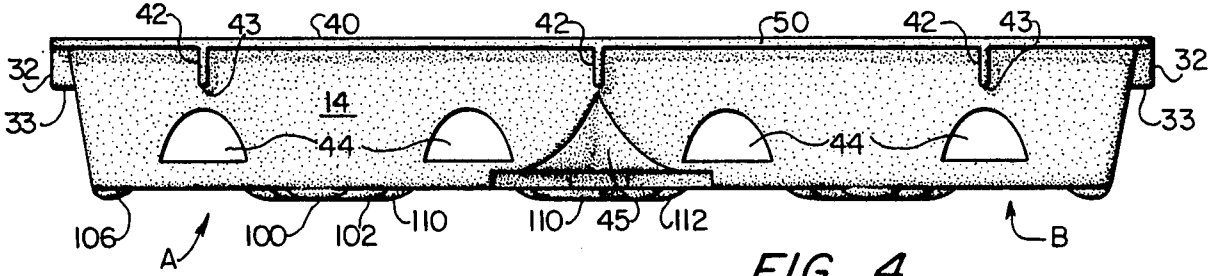
Figure 5:
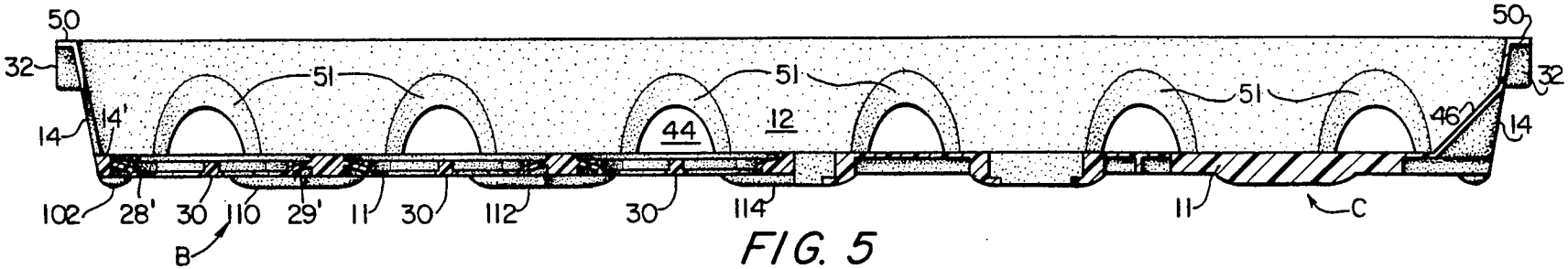
FIG. 5 is a section view taken at line 5—5 of FIG. 1.
Figure 7:
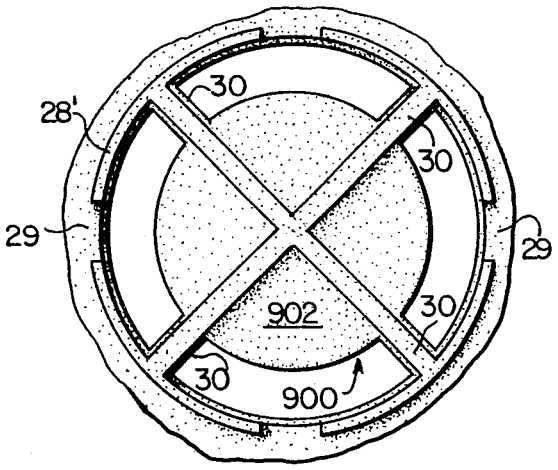
FIG. 7 is a top plan view of the year date coding ring shown in FIG. 6.
Figure 6:
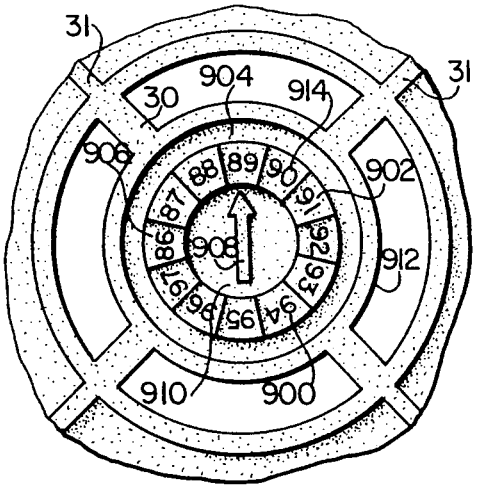
FIG. 6 is a bottom plan view of a molded year date coding ring incorporated in one embodiment of the present invention.
Figure 9:
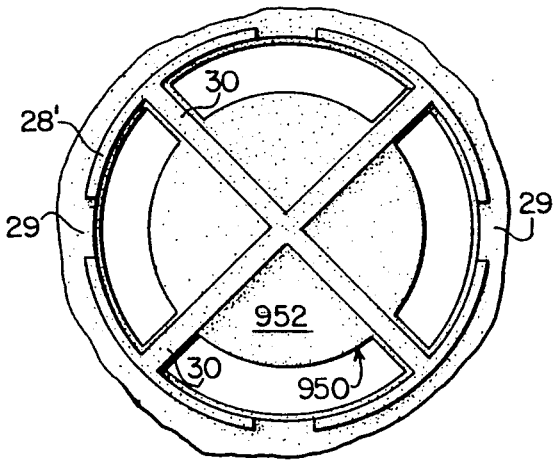
FIG. 9 is a top plan view of the date coding ring of FIG. 8.

As is further shown by FIGS. 3, 4 and 5, end walls 14 and front and rear walls 12 are provided with a plurality of contoured cut-out windows 44 each of which provides clearance space for receiving a portion of the lower end of a can placed within the tray 10. In the preferred embodiment illustrated in the drawings, front and rear walls 12 are provided with six windows 44 and end walls 14 are provided with four windows 44.

The contoured windows are generally elliptically arcuate in shape, a shape produced by conceptually intersecting to walls 12 and 14 with a vertical cylinder identical to a right cylindrical can body seated in a channel 29 of the tray 10 to define an elliptical arcuate cylindrical surface bordering each opening 44 on the inner surface of its respective wall. Although walls 12 and 14 are angled, the sides of a right cylindrical can body placed within the tray 10 are perpendicular to the tray bottom plane; consequently the elliptically arcuate cylindrical contour surfaces 51 of windows 44 shown in FIGS. 1, 2 and 5 are not angled but rather are perpendicular to the tray bottom plane. Surfaces 51 conform to the cylindrical surface of the lower end of a can positioned adjacent each surface 51.

Use of the windows 44 permits the peripheral dimensions of the tray bottom portion to be less than the overall length and width of rows of cans placed in the tray. In other words, the distance between front and rear edges 12' of the tray bottom portion 11 is less than the distance between the front and rear facing cylindrical surfaces 51 (such as exemplified by the facing cylindrical surfaces labelled 51' in FIG. 1). Similarly, the distance between end edges 14' of the can bottom portion 11 is less than the distance in the Y axis direction between the facing cylindrical surfaces labelled 51'' in end walls 14 in FIG. 1. Thus, a row of six cans extending in the Y axis direction between surfaces 51'' would have a total length (equal to six times the diameter of each can) greater than the distance between end edges 14'; similarly, a front-to-rear row of cans extending in the Y axis direction between surfaces 51' would have a greater length (equal to four times the diameter of each can) than the distance between front and rear edges 12' of the bottom portion of the tray.

The employment of a tray bottom having such length and width dimensions less than the length and width dimensions of can rows used in the tray is essential to permit interlocked cross-tied stacking of trays with a minimum of overhang of the perimeter of a pallet. If the peripheral dimensions of the tray were larger, a desired cross-tied stacked arrangement of trays would overhang the perimeter of a standard pallet to a greater degree, exposing the cans and trays to damage by the fork lift trucks used to warehouse and ship them.

Figure 10A:
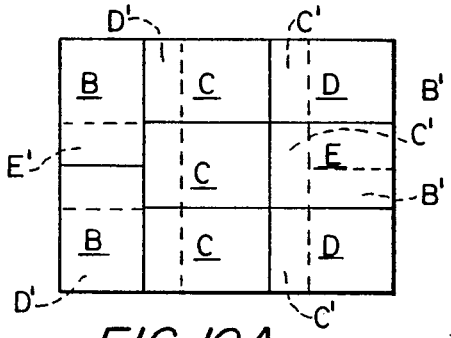
FIG. 10A is a schematic top plan view of two eight can tray tiers showing some of the different positions which can trays according to the present invention may occupy within a pallet tier relative to subjacent can trays.
Figure 10B:
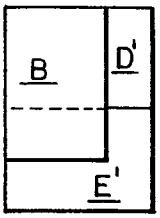
FIG. 10B is a schematic plan view illustrating a first position which a can tray according to the present invention may occupy relative to subjacent can trays within the pallet arrangement of FIG. 10A.
Figure 10C:
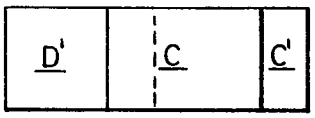
FIG. 10C is a schematic plan view illustrating a second position which a can tray according to the present invention may occupy relative to subjacent can trays within the pallet arrangement of FIG. 10A.
Figure 10E:
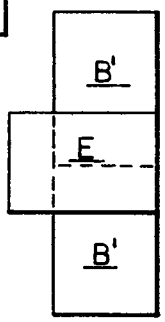
FIG. 10E is a schematic plan view illustrating a fourth position which a can tray according to the present invention may occupy relative to subjacent can trays within the pallet arrangement of FIG. 10A.

Further, with larger tray dimensions it would be impossible to use a cross-tied stacked, palletized arrangement while maintaining relatively close axial alignment of cans in subjacent and superior can rows. Axial misalignment of cans in subjacent and superior can rows of stacked trays occurs because subjacent and superior can trays may be rotated 90° with respect to one another with such rotation causing a shifting of trays in proportion to the number of trays arranged in a particular tier array. FIG. 10A schematically depicts the arrangement of two eight can tiers of can trays in a cross-tied palletized arrangement. Many other crosstied palletized arrangements may be practiced, to facilitate use of the invention with different pallet sizes. Examples of other cross-tied palletized arrangements commonly practiced in the beverage can industry are illustrated schematically in FIGS. 11A, 11B and 11C.

Figure 10D:
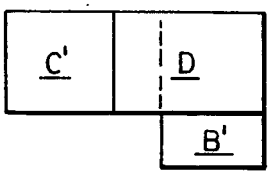
FIG. 10D is a schematic plan view illustrating a third position which a can tray according to the present invention may occupy relative to subjacent can trays within the pallet arrangement of FIG. 10A.
Figure 11A:
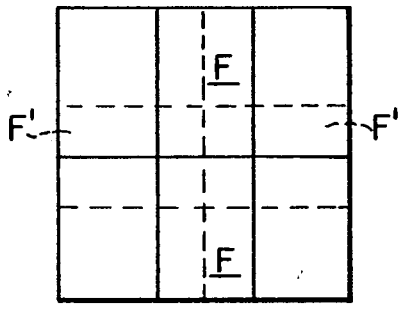
FIG. 11A is a schematic top plan view of a first six can tray per pallet tier arrangement.

The solid lines in FIG. 11A depict six trays per tier. In the pattern shown in FIG. 11B each tier comprises seven trays. Further, the palletizing patterns shown in FIGS. 10A and 11C each comprise eight trays per tier. These four palletizing patterns may be constructed by placing can trays in one of six different positions B, C, D, E, F and G, as shown in FIGS. 10A through 10G. The subject inventive tray is provided with downwardly protruding interlock standoffs for engaging the upper ends of subjacent cans to accommodate for each different position which the cans may occupy in the respective different stacked arrangements.

In the arrangement shown in FIG. 10A, superior can trays (those in the upper tier) are outlined in solid lines and subjacent can trays (those in the lower tier) are outlined using phantom lines. As indicated on FIG. 10A a given superior can tray may occupy any one of four positions with respect to subjacent can trays with the trays in such four possible positions being labelled B, C, D or E.

It will be observed that the cans in the subjacent tier are arranged relative to each other in a manner identical to the relative arrangement of the cans in the upper tier; however, the lower tier is rotated 180° relative to the upper tier. The trays in the subjacent tier are labelled with printed designators B′, C′, D′ and E′ which respectively correspond to positions B, C, D and E of the upper tray. As is shown in detail in FIG. 10A, both of the can trays labelled A rest on portions of two subjacent can trays having their transverse axes Y parallel in the manner illustrated by the rearmost tray B (as viewed in FIG. 10A) as shown in FIG. 10*a*. However, any one of the three can trays C of FIG. 10A rests directly above two end-to-end abutted can trays a of the subjacent tier in the manner shown in detail in FIG. 10C. Further, as shown in FIG. 10D, the rearmost can tray D of FIG. 10A rests directly above and on two subjacent can trays B′ and C′ which are arranged perpendicular to one another. The forwardmost can tray D of FIG. 10A rests on the same trays A′ and the forwardmost tray C′ of the subjacent tray. A can tray E of the upper tier rests horizontally atop two end-to-end abutted can trays A′ and the middle can tray C′ of the subjacent row.

Figure 10F:
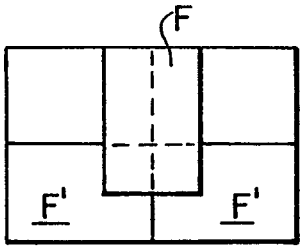
FIG. 10F is a schematic plan view illustrating a fifth position which a can tray according to the present invention may occupy relative to subjacent can trays within the pallet arrangement of FIG. 10A.

Can tray F of the six can array of FIG. 11A rests on four subjacent trays B′, B′, F′ and F′ which are rotated 90° from the trays of the upper tier as shown in FIG. 10F. The four remaining trays of FIG. 11A are corner trays supported by subjacent trays in exactly the same manner as can trays B of FIG. 10A.

Figure 11B:
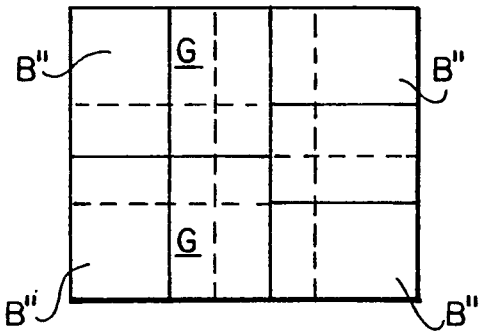
FIG. 11B is a schematic top plan view of a second six can tray per pallet tier arrangement.
Figure 10G:
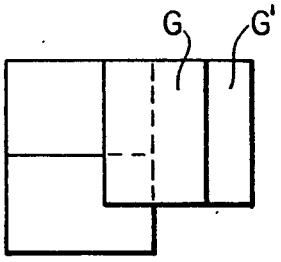
FIG. 10G is a schematic plan view illustrating a sixth position which a can tray according to the present invention may occupy relative to subjacent can trays within the pallet arrangement of FIG. 10A.

The three can tray positions G of the seven can tray uppermost tier of FIG. 11B are illustrated in FIG. 10G. It should be observed that the four can trays A″ defining the corners of the upper tier of FIG. 11B are supported by two subjacent trays in the exact same manner as trays B of the upper tier of FIG. 10A. Tray F″ is supported by four subjacent trays in the exact manner as tray F of FIGS. 11A and 10F. The lower tier of trays in FIG. 11B is rotated 180° from the upper tier of which it is consequently a mirror image.

Figure 11C:
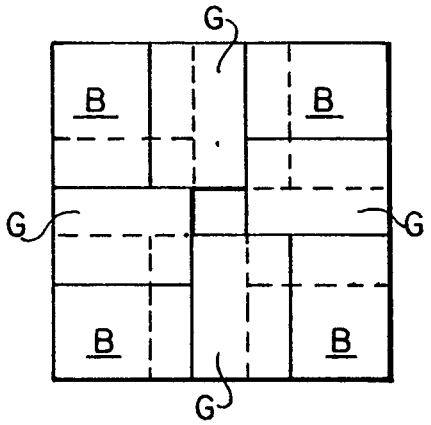
FIG. 11C is a schematic top plan view of a second eight can tray per pallet tier arrangement.

FIG. 11C illustrates an eight can tray tier arrangement in which the lower tier is rotated 90° from the upper tier. The can trays B of the upper tier of FIG. 11C are supported by subjacent can tray in the exact same manner as can trays a of FIG. 10A; similarly the can trays G of FIG. 11C are supported by three trays in the manner of the rearmost G of FIG. 11C as illustrated in FIG. 10G.

Figure 12:
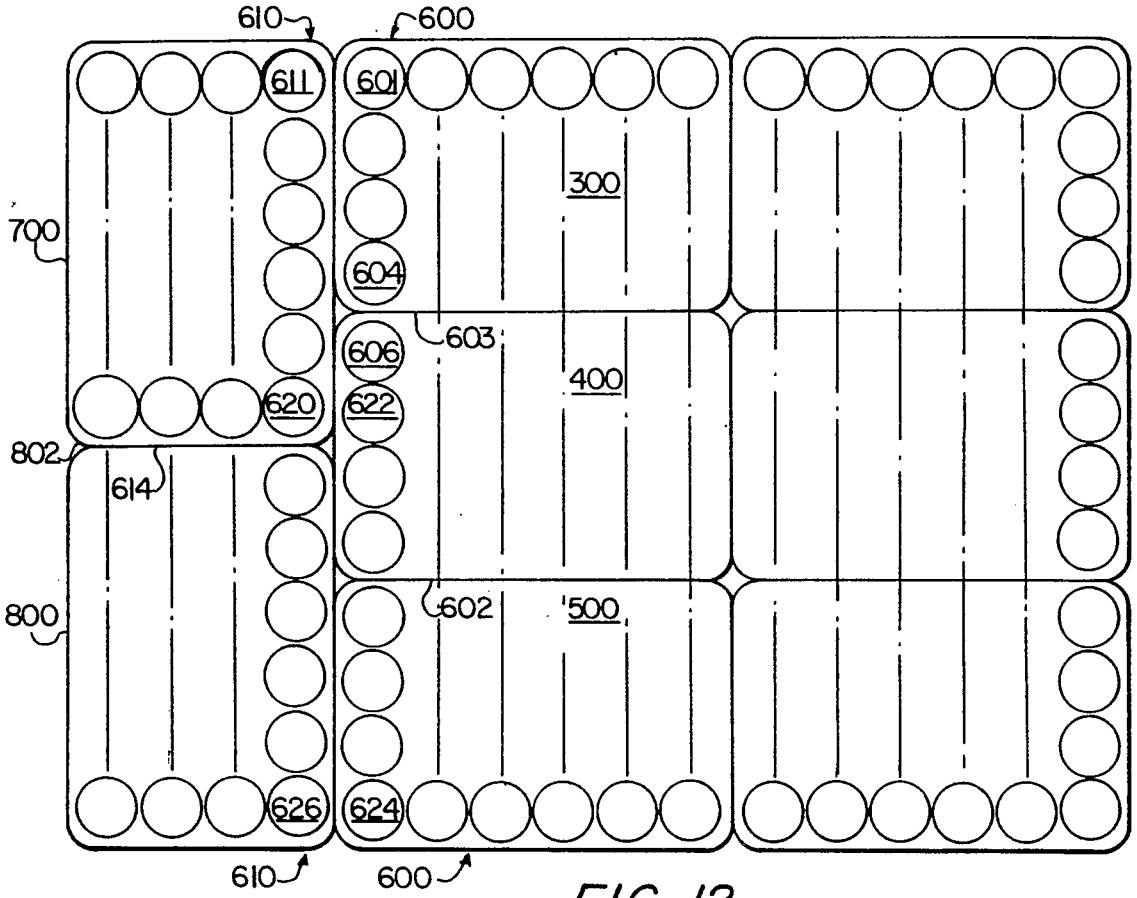
FIG. 12 is a schematic top plan view of one tier of a palletized stack of eight beverage can trays arranged in the manner of FIG. 10A with the can diameter profiles being illustrated therein.

The design of the interlocked standoffs of a tray 10 according to the present invention accommodates placement of the tray 10 relative to subjacent trays in any of the positions exemplified by trays A, C, D, E, F or G. Specifically, the tray according to the invention is capable of interlocking with cans in subjacent trays in at least six different positions in which the tray is placed in a superior tier. Additionally, the interlock standoffs account for the fact that the pallet arrangement shown in FIGS. 10A and 11B could be rotated 180°, thereby creating a mirror image of the center-line locations of the cans in each of the four positions. The design of the standoffs is discussed below in detail. Depending upon the arrangement of adjacent loaded trays, the distance between axes of widely spaced-apart cans may change substantially. For example, as shown schematically in FIG. 12, if three loaded trays 300, 400 and 500 are placed adjacent to one another such that their walls 12 are flush, twelve cans in a front to rear extending row 600 parallel to end walls 14 of the three trays 300, 400 and 500 will be interrupted by two double tray wall thicknesses 603 and 604, each of which is equal to the distance between facing cans of two trays such as, for example, cans 604 and 606 in FIG. 12. In contrast, if two trays 700 and 800 are placed end-to-end such that their end walls 14 are adjacent, only one double tray wall thickness 802 will be interposed in a row 610 of twelve cans. Thus, the distance between the first can 611 of row 610 and the sixth can 620 of that row is less than the distance between corresponding first and sixth cans 601 and 622 of row 600, with the difference being equal the spacing between cans 604 and 606 of row 600 caused by double wall thickness 603. In like manner, the distance between first can 601 and twelfth can 624 of row 600 is greater than the distance between the first and twelfth cans 611 and 626 of row 610.

The different number of walls potentially interposed in a row of a given number of cans can cause the distance between cans to vary greatly both in the X and Y direction. This varying distance causes the axes of cans in subjacent and superior rows to become misaligned in cross-tied pallet stacks. For example, as shown in FIG.

12, cans 620 and 622 are misaligned. As a result of this misalignment, as discussed further below, the can trays 10 are provided with downwardly protruding interlock standoffs for engagement with cans of a subjacent tier which permit interlocking with cans despite the varying misalignment position of cans in vertically adjacent stacked trays.

Figure 16:
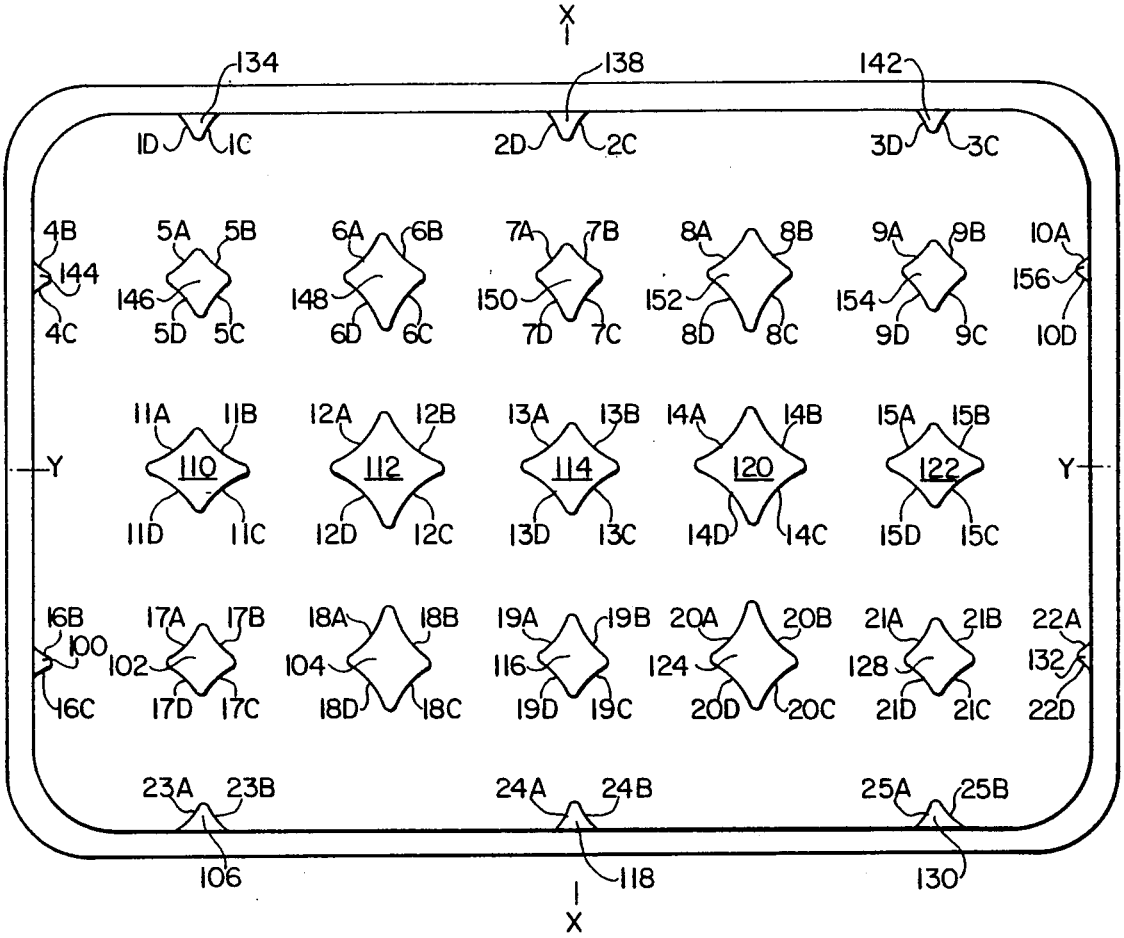
FIG. 16 is a schematic bottom plan view of a portion of a tray according to the present invention showing the arcuate can engaging surfaces of interlock standoffs provided to engage the sides of the upper ends of subjacent cans.

More specifically, referring now to FIGS. 2, 3, 4 and 5, the bottom of the tray is provided with downwardly protruding interlock standoffs including six front/rear wall adjacent identical standoffs 106, 118, 130, 134, 138 and 142 as best shown in FIGS. 2 and 16, and four identical end wall adjacent standoffs 100, 144, 156 and 132. Additionally Y axis standoffs 110, 112, 114, 120 and 122 are positioned along the Y axis and X axis standoffs are positioned along the X axis along with front/rear standoffs 118 and 132 and standoff 114 which is positioned over the intersection of the X and Y axes. All standoffs serve to engage portions of the top edges of cans placed in a subjacent loaded tray. The standoffs, thus, operate to prevent lateral movement of loaded can trays in a palletized stack by providing a positive stop against which can top outer walls may rest during sudden lateral movement.

It should be noted that standoffs 102, 104, 116, 124 and 128 are mirror images of standoffs 146, 148, 150, 152 and 154, respectively; similarly, standoffs 110 and 112 are mirror images of standoffs 122 and 120, respectively. Different shapes are required because when a plurality of trays 10 are stacked atop a pallet in a cross-tied stack, such that subjacent trays are oriented at a 90° angle with respect to superior trays, can tops of subjacent trays are not always axially aligned with can bodies placed in superior trays.

Due to axial misalignment discussed in detail above, the outer top wall of a can placed within a subjacent tray is not always aligned directly below a can support ring 28 of a superior tray. Therefore, the arcuate edges of standoffs 102 through 156 are designed to accommodate for the possible distance to which a particular can edge in a subjacent row may extend.

Figure 15:
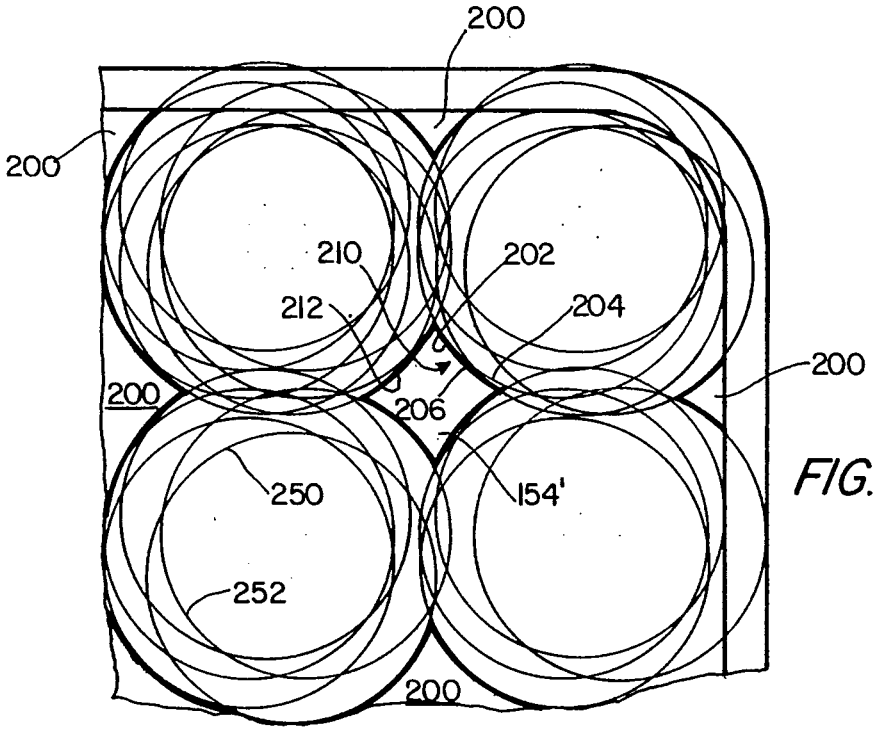
FIG. 15 is an exaggerated non-scale schematic plan view of possible can positions within a tray according to the preferred embodiment of the present invention.

The exact shape of the standoffs is determined by plotting a schematic diagram of all possible can locations for all possible positions and rotations of subjacent and superior trays in a given stacked, interlocked, cross-tied pallet arrangement. FIG. 15 is a diagram plan view of all possible can positions for four cans of one quadrant. Such a schematic diagram is simply one way of visualizing the different distances which may separate cans due to the varying number of wall thicknesses which may be interposed in can rows in the various cross-tied pallet arrangements. After the circular profiles of all such can locations are plotted as represented by circles such as 250 and 252 of FIG. 15, the open spaces between the can profiles, such as space 154' in FIG. 15, indicate essentially the final shape of the standoffs for that particular position which in the case of FIG. 15, would be standoff 154; however, the standoffs are provided with rounded corners rather than sharp edges as will be apparent from comparison of standoff 154 with open space 154'.

However, in some cases in which two or more can positions are extremely close, a complex curve 210 is created comprising multiple arcuate portions 202 whose ends 204 are joined at a relatively acute angle 206. In these cases, as shown in FIG. 8, the design of the standoff is slightly changed to remove the acute angle 206 and to smooth the complex multiple arcuate curve 208 into a single smooth curve such as curve 212. Such curve smoothing simplifies the task of preparing a master can tray mold, and reduces the amount of molding material required to produce a tray, without substantially reducing the amount of contact made between cans and interlock standoffs having smoothed curves.

Since the standoffs provide clearance for the most greatly misaligned can associated with a given tray can axis position, all of standoffs 100 through 156 do not necessarily contact a subjacent can in a given tray position. In one case, specifically arcuate surface 18D of interlock 104 (FIG. 16), the arcuate surface of an interlock will be directly flush against the side of the top of a can in a subjacent tray. However, as few as 16 of the 25 standoffs may actually contact and laterally restrain subjacent cans in a fully-loaded subjacent tray. Fortunately, contact by less than all of the standoffs is sufficient to ensure load stability given the large number of trays present in a typical stacked, cross-tied, palletized arrangement.

The standoffs of a given tray which contact cans in a given subjacent tray may be predicted for all possible tray locations within a pallet using information presented in schematic FIG. 16 and the standoff pad identification chart shown in Table 1. In FIG. 16, each arcuate surface of each protruding standoff of a tray according to the present invention is designated by a specific reference letter; thus, each arcuate surface can be identified by the number of the standoff on which it occurs and its associated reference letter.

Table 1 has vertical columns B through G which correspond to the superior tray to subjacent tray relationships B through G within one of the four preferred palletized arrangements shown in FIGS. 10A, 11A, 11B and 11C. The horizontal rows of Table 1 correspond to the arcuate surfaces of protruding standoff pads identified in FIG. 16. Thus, by referring to Table 1, and choosing the column corresponding to the superior tray relationship to a subjacent tray of a can tray within a pallet stack, the protruding interlock standoff arcuate surfaces which will contact cans in a subjacent tray may be determined.

TABLE 1

Interlock Pad Identification Chart
The Interlock Pad Identification Chart Shown Below; Identifies Which Of The Interlock Pads Are In Use In Each Of The Six Basic Palletizing Positions

| Interlock Pad Identification | Superior Tray Relationship To Subadjacent Tray Number | | | | | |
|---|---|---|---|---|---|---|
| | B | C | D | E | F | G |
| 134C | x | x | x | x | X | x |
| 134D | | x | x | | | x |
| 138C | | x | x | x | | x |
| 138D | | x | x | x | | x |
| 142C | | x | x | | | x |
| 142D | x | x | x | x | x | x |
| 144B | X | | | x | x | x |
| 144C | | X | X | | | |
| 146A | X | | | | X | |
| 146B | X | | | x | x | x |
| 146C | | x | x | x | x | x |
| 146D | | x | x | | | x |
| 148A | x | | | | x | |
| 148B | X | | | x | x | |
| 148C | | X | X | X | | x |
| 148D | | | x | | | x |
| 150A | x | | | x | x | |
| 150B | x | | | x | x | |
| 150C | | X | X | | | x |
| 150D | | x | x | x | | x |
| 152A | x | | | x | x | |
| 152B | X | | | | X | |

TABLE 1-continued

Interlock Pad Identification Chart
The Interlock Pad Identification Chart Shown Below, Identifies Which Of The Interlock Pads Are In Use In Each Of The Six Basic Palletizing Positions

| Interlock Pad Identification | Superior Tray Relationship To Subadjacent Tray Number | | | | | |
|---|---|---|---|---|---|---|
| | B | C | D | E | F | G |
| 152C | | x | x | | | x |
| 152D | | X | X | X | | x |
| 154A | x | | | x | x | x |
| 154B | X | | | | X | |
| 154C | | X | X | | | |
| 154D | | x | x | | | x |
| 156A | x | | | x | x | x |
| 156D | | x | x | | | |
| 110A | X | | | | x | |
| 110B | X | | | x | x | x |
| 110C | X | | | X | x | x |
| 110D | X | | | | | |
| 112A | X | | | | X | |
| 112B | x | | | x | x | |
| 112C | x | | | x | x | |
| 112D | X | | | | | |
| 114A | x | | | x | x | |
| 114B | x | | | x | x | |
| 114C | x | | | x | x | |
| 114D | x | | | x | x | |
| 120A | x | | | x | x | |
| 120B | x | | | | x | |
| 120C | x | | | | x | |
| 120D | x | | | x | x | |
| 122A | X | | | x | x | x |
| 122B | x | | | | x | |
| 122C | x | | | | x | |
| 122D | X | | | x | x | x |
| 100B | | X | X | | | |
| 100C | x | | | x | x | x |
| 102A | | x | x | | | x |
| 102B | | X | X | | | x |
| 102C | x | | | x | x | x |
| 102D | X | | | | | |
| 104A | | X | X | | | x |
| 104B | | X | X | X | | X |
| 104C | X | | | X | X | |
| 104D | X | | | | x | |
| 116A | | X | X | | | x |
| 116B | | X | X | X | | x |
| 116C | x | | | x | | x |
| 116D | x | | | x | | x |
| 124A | | X | X | X | | x |
| 124B | | | X | | | x |
| 124C | X | | | | X | |
| 124D | | | | X | X | |
| 128A | | x | x | x | | x |
| 128B | | x | x | | | x |
| 128C | x | | | | x | |
| 128D | x | | | x | x | x |
| 132A | | X | X | | | |
| 132D | X | | | x | x | x |
| 106A | | x | x | | | x |
| 106B | x | x | x | x | x | x |
| 118A | | X | X | X | | x |
| 118B | | x | x | | | x |
| 130A | x | x | x | x | x | x |
| 130B | | x | x | | | x |

Referring now to FIGS. 1 and 2, the preferred embodiment of a can tray according to the present invention includes six molding gates 49 to facilitate filling of the can tray mold using a conventional plastic injection-molding technique. Since can trays according to the present invention are relatively large, provision of plural plastic injection points on the mold is essential to ensure that the molded trays cool evenly and consistently. Using fewer injection molding gates 49 might cause different portions of a molded can tray 10 to cure at different rates, producing differential shrinkage and resulting warpage of the finished molded tray. This effect is eliminated by using a plurality, preferably six, of injection molding gates for filling the can tray mold with molten plastic.

Many modifications and variations of the present invention are possible considering the above teachings and specification. Therefore, within the scope of the appended claims, the invention may be practiced otherwise than as specifically described above.

What is claimed is:

1. An interlockably stackable and deeply-nestable beverage can tray comprising:

front and rear walls for containing cans within said tray;

end walls for containing cans within said tray;

said front and rear walls and said end walls have length dimensions related by a 3:2 ratio;

tray bottom means for supporting cans having an interior surface and an exterior surface;

a plurality of can seating means arranged in front-to-rear extending rows and end-to-end extending rows for receiving can bottoms and for preventing lateral movement of said can bottoms;

a plurality of downwardly extending can interlock means for engaging can tops of cans in a subjacent can tray and for limiting lateral movement of said can tops; and said front and rear walls and said end walls each having a plurality of can receiving openings aligned with said can seating means for permitting cans placed in said tray to partially extend through said openings beyond said front and rear walls and said end walls.

2. The tray of claim 1, wherein said front and rear walls and end walls for containing cans within said tray are canted inwardly from top to bottom.

3. The tray of claim 2, wherein said front and rear walls and said end walls are canted at an angle of approximately 10° with respect to a plane perpendicular to said tray bottom means.

4. The tray of claim 3, wherein said can receiving openings for permitting cans placed in said tray to extend beyond said front and rear walls and said end walls comprise a plurality of contoured window cut-outs;

said cut-outs having a shape defined by an elliptical arch perpendicular to said tray bottom, and a chord thereof; and said cut-outs being spaced-apart along said front wall and said rear wall such that each of said cut-outs is aligned with a row of can seating means.

5. The tray of claim 4, wherein said tray bottom means comprises:

first molded structural channel means defining a transverse axis for said tray;

said first channel means comprising a plurality of elongated vertical ribs of rectangular cross-section having a top rib surface and a bottom rib surface;

said first channel means being perpendicularly secured at each end to one of said end walls at a point approximately midway between the ends of said end walls; second molded structural channel means defining a front-to-rear axis for said tray; said second channel means comprising a plurality of elongated vertical ribs of rectangular cross-section having a top rib surface and a bottom rib surface; and said second channel means being perpendicularly secured to said front and rear walls at a point approximately midway between the ends of said front and rear walls.

6. The tray of claim 5, wherein each of said can seating means comprises:

a plurality of tapered circular channels for nestingly receiving the bottom of a beverage can;

each of said circular channels being defined by a first interior ring, a second exterior ring, and a frustoconical annular floor connecting said first and second rings;

said first ring and said second ring being concentrically positioned relatively to each other on said frustoconical annular floor from which they extend upwardly;

two molded diagonal cross ribs, said cross ribs each forming a diameter of said second ring, and said cross ribs being disposed at a 45° angle with respect to said side wall means and said end wall means.

7. The tray of claim 6, wherein said tray bottom means further includes:

a plurality of ring link ribs, said link ribs being secured to said first rings; and said link ribs being disposed parallel to one or the other of said axes.

8. The tray of claim 7, wherein said downwardly extending can interlock means for accepting can tops comprises:

a plurality of standoffs projecting downwardly from said tray bottom;

said standoffs being disposed to laterally engage the top outer surface of selected ones of cans placed in a subjacent tray; and said standoffs having plural concave arcuate side surfaces for engaging selected subjacent cans;

said plural concave arcuate surfaces being defined by:

generating a pallet pattern comprising a plurality of superior can tray relationships to subjacent can trays, said relationships each including a first plurality of can center locations;

generating a reference relationship including a second plurality of reference can center locations, wherein each of said reference can center locations is intersected by an X axis and a Y axis, said X axis and said Y axis being arranged perpendicular to one another and parallel to said tray wall means;

calculating plural X axis values and plural Y axis values by computing the distance, along said X axis and said Y axis, between each of said first can center locations and each of said reference can center locations;

associating each of said x axis values and each of said Y axis values with one of said reference can center locations;

computing the maximum X axis value and the maximum Y axis value associated with each of said reference can center locations;

computing a plurality of arcs, each of said arcs being associated with one of said reference can center locations, each of said arcs subtending an angle of 90 degrees, and each of said arcs having a radius center point defined by said maximum X axis value and said Y axis value;

associating each of said arcs with one of said reference can locations;

computing intersection points at which said arcs intersect, and truncating said arcs at said intersection points 9. The tray of claim 8, wherein said first molded structural channel means includes:

a plurality of channel cut-outs; and wherein the shape of said channel cut-outs is defined by a trapezoid having non-parallel sides curved inwardly.

10. The tray of claim 9, wherein said second molded structural channel means comprises:

a plurality of channel cut-outs; and wherein the shape of said channel cut-outs is defined by a trapezoid having non-parallel sides curved inwardly.

11. A molded, interlockably stackable and deeply nestable beverage can tray comprising:

first wall means for containing cans within said tray;

second wall means for containing cans within said tray;

said first wall means and second wall means having length dimensions forming a 3:2 ratio;

said first wall means and second wall means having a plurality of can clearance means for permitting cans placed in said tray to extend beyond said first wall means and beyond said second wall means;

tray bottom means for supporting cans, said tray bottom means having an interior surface and an exterior surface;

a plurality of can seating means for receiving can bottoms and preventing lateral movement of said can bottoms, said can seating means being disposed upon said tray interior surface; and a plurality of can interlock means for accepting can tops and preventing lateral movement of said can tops, said interlock means being secured to said exterior surface.

12. An interlockably stackable and deeply-nestable beverage can tray comprising:

two angularly molded tray side walls;

said sides being relatively elongated in length and relatively short in height;

said sides being disposed at an angle of 10° with respect to a plane perpendicular to said tray bottom means;

two angularly molded tray end walls;

said ends being relatively elongated in length and relatively short in height;

said ends being disposed at an angle of approximately 10° with respect to a plane perpendicular to said tray bottom means;

a plurality of molded, contoured window cut-outs;

said cut-outs having a shape defined by an elliptical arch perpendicular to said tray bottom and a chord thereof;

said cut-outs being spaced-apart along said first wall means and said second wall means such that said cut-outs are opposite can positions within said tray;

a first molded structural channel;

said first channel comprising a plurality of elongate molded ribs of rectangular cross-section having a top rib surface and a bottom rib surface;

said first channel being perpendicularly secured to said end wall means at a point approximately midway between the ends of said end walls;

a second molded structural channel;

said second channel comprising a plurality of elongate molded ribs of rectangular cross-section having a top rib surface and a bottom rib surface;

said second channel being perpendicularly secured to said side wall means at a point approximately midway between the ends of said side wall means;

can seating means comprising a tapered circular channel for receiving the bottom of a beverage can;

said channel comprising a first molded ring and a second molded ring;

said first ring and said second ring having different diameter dimensions;

said first ring and said second ring being disposed in a concentric, non-co-planar arrangement;

said first ring and said second ring being connected by an angularly molded flat ring base;

two molded diagonal cross ribs;

said cross ribs each forming a diameter of said second ring;

said cross ribs disposed at a 45° angle with respect to said side walls and said end walls;

a plurality of ring link ribs; said link ribs secured to said first rings;

said link ribs being disposed parallel to said side walls and said end walls;

a plurality of standoffs projecting downwardly from said tray bottom;

said standoffs being disposed to laterally engage the top outer surface of selected ones of cans placed in a subjacent tray; and said standoffs having plural concave arcuate side surfaces for engaging selected subjacent cans;

said plural concave arcuate surfaces being defined by:

generating a pallet pattern comprising a plurality of superior can tray relationships to subjacent can trays, said relationships each including a first plurality of can center locations;

generating a reference relationship including a second plurality of reference can center locations, wherein each of said reference can center locations is intersected by an X axis and a Y axis, said X axis and said Y axis being arranged perpendicular to one another and parallel to said tray wall means;

calculating plural X axis values and plural Y axis values by computing the distance, along said X axis and said Y axis, between each of said first can center locations and each of said reference can center locations;

associating each of said X axis values and each of said Y axis values with one of said reference can center locations;

computing the maximum X axis value and the maximum Y axis value associated with each of said reference can center locations;

computing a plurality of arcs, each of said arcs being associated with one of said reference can center locations, each of said arcs subtending an angle of 90 degrees, and each of said arcs having a radius center point defined by said maximum X axis value and said Y axis value;

associating each of said arcs with one of said reference can locations;

computing intersection points at which said arcs intersect, and .

truncating said arcs at said intersection points.

13. A rectangular can tray having a front-to-rear axis and a transverse axis perpendicular to said front-to-rear axis, so that said axes divide said tray into four quadrants comprising a left front quadrant, a left rear quadrant, a right rear quadrant, and a right front quadrant, said can tray comprising:

(a) parallel front and rear walls;

(b) parallel end walls;

(c) a bottom portion of generally rectangular configuration and having front and rear edges from which said front and rear walls extend upwardly and end edges from which said end walls extend upwardly;

(d) plural individual can bottom receiving means for receiving plural individual cans, said receiving means being provided in said bottom portion extending in front-to-rear rows parallel to said front-to-rear axis and in transverse rows parallel to said transverse axis;

(e) wherein the distance between said front-to-rear edges of said bottom portion is less than the sum of the diameters of all of the cans of one of said front-to-rear rows and the distance between said end edges of said bottom portion is less than the sum of the diameters of all of the cans seatable in one of said transverse rows;

(f) openings provided in said front and rear walls in alignment with said front-to-rear rows of said can bottom receiving means for receiving those portions of end cans in such rows which protrude beyond the front and rear edges of said bottom portion; and (g) openings provided in said end walls in alignment with said transverse rows of said can bottom receiving means for receiving those portions of end cans in such rows which protrude beyond the end edges of said bottom portion.

14. The tray of claim 13, wherein said front, rear, and end walls are canted downwardly inwardly, and further including:

(a) a front top lip and a rear top lip secured to and respectively parallel to said front and rear walls;

(b) parallel end lips secured parallel to said end walls;

(c) plural front nesting tabs and plural rear nesting tabs secured to said top lip and extending vertically downwardly therefrom; and (d) plural end nesting tabs secured to said end lips and extending vertically downwardly therefrom.

15. The tray of claim 14, wherein said can bottom seating means are adapted to receive can bottoms of different diameter sizes and include (a) plural concentric, non-co-planar can bottom seating rings, and (b) means for connecting said rings.

* * * * *

UNITED STATES PATENT AND TRADEMARK OFFICE

CERTIFICATE OF CORRECTION

PATENT NO. : 5,031,774

DATED : July 16, 1991

INVENTOR(S) : Peter M. Morris and Robert C. Allabaugh

It is certified that error appears in the above-identified patent and that said Letters Patent is hereby corrected as shown below:

On the title page, in item [73]:

At the name of the Assignee, delete "Paper Casepro" and insert in place thereof --Piper-Casepro--.

Signed and Sealed this

Eighth Day of December, 1992

*Attest:*

DOUGLAS B. COMER

*Attesting Officer*

*Acting Commissioner of Patents and Trademarks*